US005498037A

United States Patent [19]

Fan Lai

[11] Patent Number: 5,498,037

[45] Date of Patent: Mar. 12, 1996

[54] DOOR LOCK ASSEMBLY

[76] Inventor: Ho-Tzu Fan Lai, No.186, Min-Kuo Rd., Chia-Yi City, Taiwan

[21] Appl. No.: 372,339

[22] Filed: Jan. 13, 1995

[51] Int. Cl.[6] ..... E05C 1/00

[52] U.S. Cl. ..... 292/1.5; 292/337; 292/DIG. 60

[58] Field of Search ..... 292/1.5, 169.15, 292/337, DIG. 60

[56] References Cited

U.S. PATENT DOCUMENTS

| | | | |
|---|---|---|---|
| 4,729,586 | 3/1988 | Fang | 292/1.5 |
| 4,736,973 | 4/1988 | Fang | 292/337 |
| 4,752,090 | 6/1988 | Lin | 292/337 |
| 4,772,055 | 9/1988 | Fang | 292/DIG. 60 |
| 4,840,412 | 6/1989 | Shen | 292/DIG. 60 |
| 4,840,413 | 6/1989 | Shen | 292/337 |
| 4,844,522 | 7/1989 | Pechar | 292/DIG. 60 |
| 4,957,315 | 9/1990 | Lin | 292/337 |
| 5,149,151 | 9/1992 | Shen | 292/1.5 |
| 5,257,841 | 11/1993 | Geringer | 292/DIG. 60 |

*Primary Examiner*—Steven N. Meyers
*Assistant Examiner*—Gary Estremsky
*Attorney, Agent, or Firm*—Kane, Dalsimer, Sullivan, Kurucz, Levy, Eisele & Richard

[57] ABSTRACT

A door lock assembly includes an elongated latch bolt having an enlarged front end portion and a cylindrical rear end portion which is formed with axially spaced and aligned first and second protrusions that cooperatively define a rear engaging groove therebetween. The first protrusion and the front end portion cooperatively define a front engaging groove therebetween. A movable member has a vertical end plate transverse to the bolt and formed therethrough with an engaging through-hole through which the rear end portion of the bolt extends fittingly and rotatably. The end plate has an annular inner wall which defines the through-hole and which is formed with a radially extending notch that is sized to permit extension of the protrusions therethrough. The inner wall of the end plate is engaged selectively within one of the engaging grooves in a manner such that the notch is deflected from the protrusions of the bolt, so as to prevent axial movement of the movable member relative to the bolt. The bolt is rotatable to align the protrusions thereof with the notch of the movable member so as to disengage the inner wall of the movable member from one of the engaging grooves and to permit axial movement of the movable member relative to the bolt in order to engage the inner wall of the movable member within the other one of the engaging grooves.

3 Claims, 4 Drawing Sheets

DOOR LOCK ASSEMBLY

BACKGROUND OF THE INVENTION

1. Field Of The Invention

This invention relates to a door lock assembly, more particularly to a door lock assembly the backset of which is adjustable.

2. Description Of The Related Art

A conventional tubular door lock assembly usually includes a front plate which is adapted to be mounted on the edge of a door, a latch bolt which extends through the front plate and into a strike plate secured to a doorframe so as to close the door, and a spindle, which is operable to extract the latch bolt from the strike plate so as to open the door. The distance from the front plate to the center of the spindle is commonly referred to as a backset. Presently, there are two types of conventional tubular door lock assembly available in the market. One type of the conventional tubular door lock assembly used for a smaller door has a backset of 60 mm, while the other type of the conventional tubular door lock assembly used for a larger door has a backset of 70 mm. However, the backset of each type of the conventional tubular door lock assembly is fixed.

SUMMARY OF THE INVENTION

Therefore, the main objective of the present invention is to provide a door lock assembly the backset of which is adjustable.

According to the present invention, a door lock assembly includes an elongated latch bolt and a driving unit. The latch bolt has an enlarged front end portion and a cylindrical rear end portion which is formed with axially spaced and aligned first and second protrusions that cooperatively define a rear engaging groove therebetween. The first protrusion and the front end portion cooperatively define a front engaging groove therebetween. The driving unit includes a movable, member having a vertical end plate transverse to the latch bolt and formed therethrough with an engaging through-hole through which the rear end portion of the latch bolt extends fittingly and rotatably. The end plate has an annular inner wall which defines the engaging through-hole and which is formed with a radially extending notch that is sized to permit extension of the protrusions therethrough. The inner wall of the end plate is engaged selectively within one of the front and rear engaging grooves, in such a manner that the notch is deflected from the protrusions of the latch bolt, so as to prevent axial movement of the movable member relative to the latch bolt. The latch bolt is rotatable to align the protrusions of the latch bolt with the notch on the movable member so as to disengage the inner wall of the movable member from one of the front and rear engaging grooves and to permit axial movement of the movable member relative to the latch bolt in order to engage the inner wall of the movable member within the other one of the front and rear engaging grooves of the latch bolt.

BRIEF DESCRIPTION OF THE DRAWINGS

Other features and advantages of the present invention will become apparent in the following detailed description of the preferred embodiment, with reference to the accompanying drawings, of which.

DETAILED DESCRIPTION OF THE PREFERRED EMBODIMENT

Figure 1:
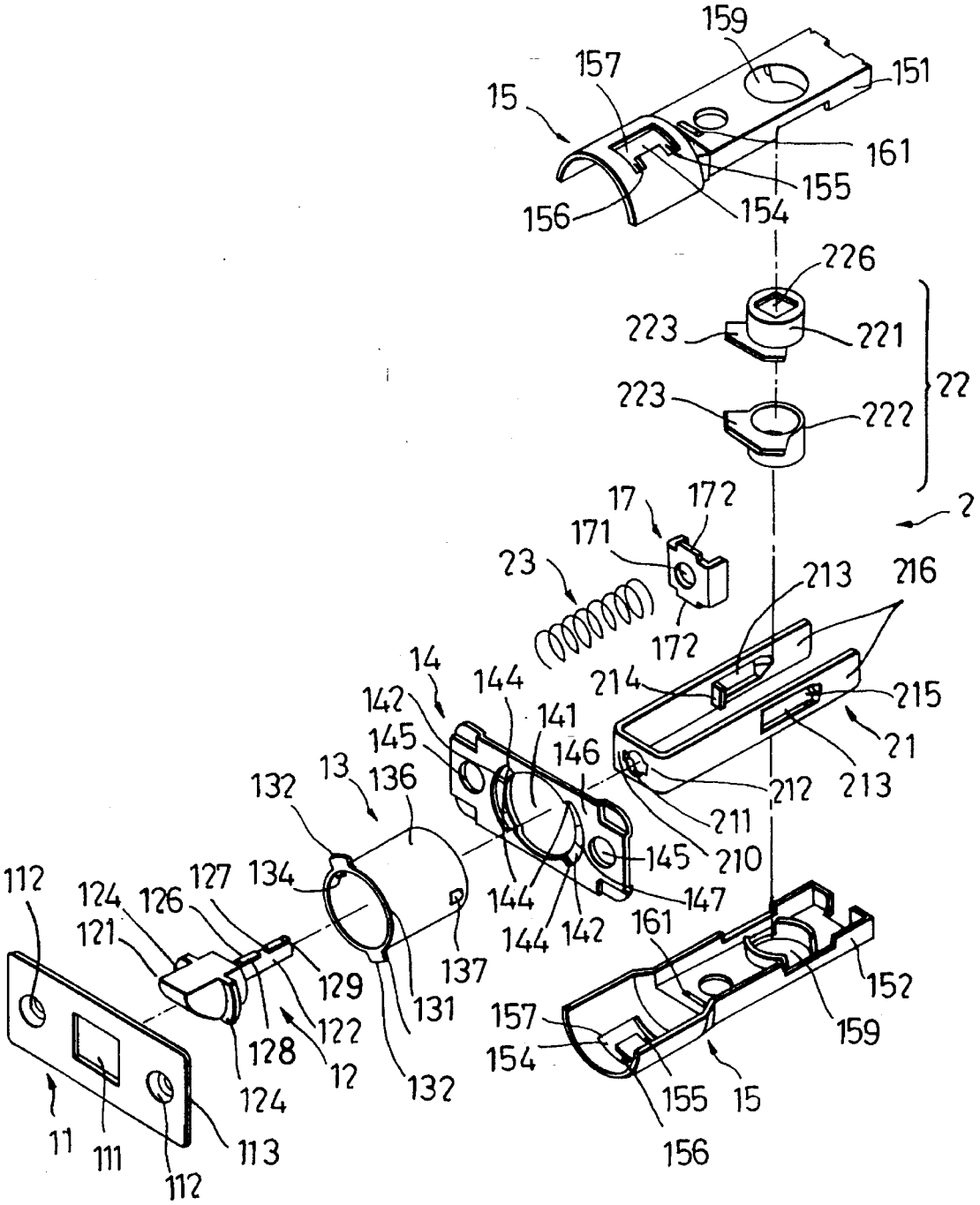
FIG. 1 is an exploded view showing a door lock assembly according to the present invention.

Referring to FIG. 1, a door lock assembly according to the present invention includes a front plate 11, an elongated latch bolt 12, a hollow cylinder 13, a rear plate 14, a hollow housing 15 and a driving unit 2. In the present embodiment, the front plate 11 is generally rectangular in shape and is formed with two opposed screw holes 112 at the two distal ends thereof. The front plate 11 has a rear abutting surface 113 and is further formed with a generally rectangular first through-hole 111 therethrough between the screw holes 112. The front plate 11 is adapted to be mounted on the edge of a door (not shown) by the extension of screws (not shown) through the screw holes 112.

The latch bolt 12 has an enlarged front end portion 121 which extends fittingly through the first through-hole 111 of the front plate, and a cylindrical rear end portion 122 which is formed with axially spaced and aligned first and second protrusions, 128 and 129. In the present embodiment, the rear end portion 122 of the latch bolt 12 is formed with two diametrically opposed first protrusions 128 and two diametrically opposed second protrusions 129. Each of the first protrusions 128 and the corresponding second protrusion 129, which are axially spaced and aligned, cooperatively define a rear engaging groove 127 therebetween. Each of the first protrusion 128 and the front end portion 121 cooperatively define a front engaging groove 126 therebetween. In the present embodiment, the front end portion 121 of the latch bolt 12 has two opposed transversely extending flanges 124.

The rear plate 14 is formed with an annular second through-hole 141 therethrough. The front end portion 121 of the latch bolt 12 extends through the second through-hole 141 of the rear plate 14. The rear plate 14 is connected securely to the front plate 11 and is, formed with two opposed locking holes 145 which are aligned respectively with a respective one of the screw holes 112 of the front plate 11. In the present embodiment, the rear plate 14 has a front abutting surface 146 which abuts against the rear abutting surface 113 of the front plate 11 and which is formed with two opposed circumferentially extending grooves 142 communicating with the second through-hole 141. Each of the engaging grooves 142 is confined by two end walls 144 and a connecting wall 147 which interconnects the end walls 144.

In the present embodiment, the cylinder 13 is sleeved on the latch bolt 12 and has a front end portion 131 formed with two opposed tabs 132 which extend radially and outwardly therefrom and respectively into a respective one of the engaging grooves 142 of the rear plate 14. The cylinder 13 further has an annular inner wall which is formed with two opposed radially and inwardly extending projections 134 adjacent to the rear abutting surface 113 of the front plate 11, and a rear end portion 136 which is formed with two opposed radially and outwardly extending protuberances 137. Each of the projections 134 and the rear abutting surface 113 of the front plate 11 cooperatively define a receiving space 135 therebetween (see FIGS. 2 and 3).

Figure 2:
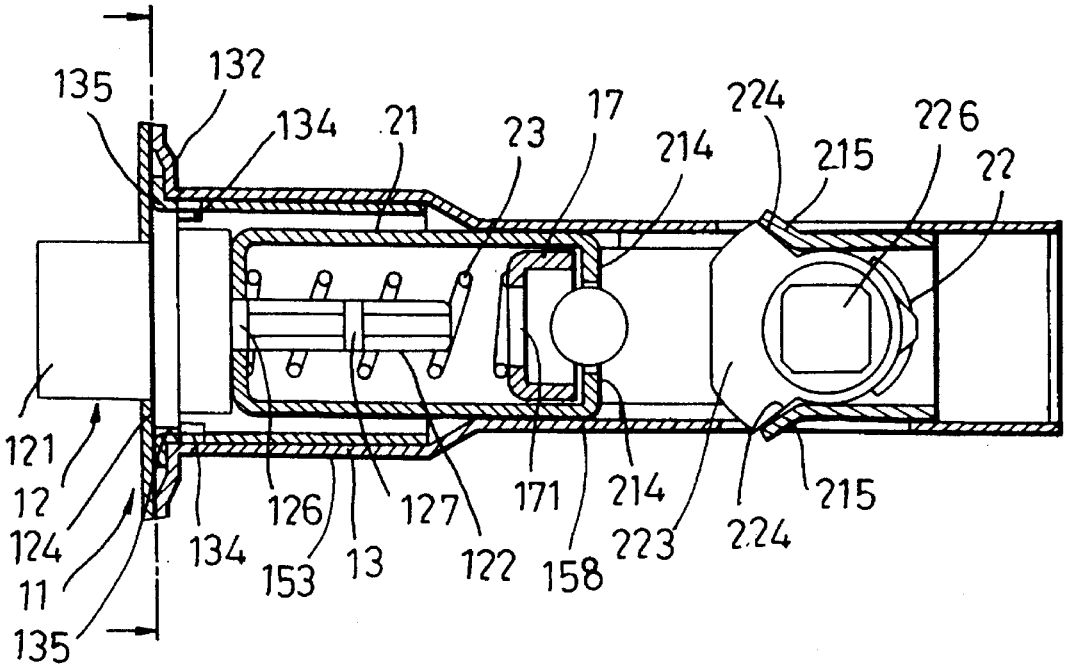
FIG. 2 is a partial sectional view illustrating the assembled door lock assembly according to the present invention.
Figure 3:
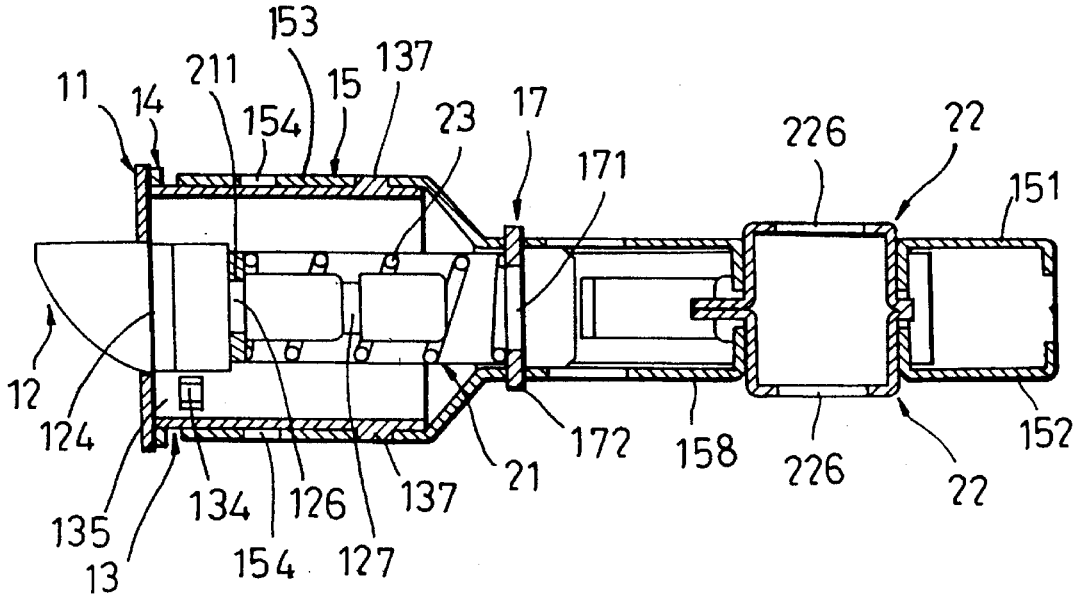
FIG. 3 is another partial sectional view illustrating the assembled door lock assembly according to the present invention.

Referring to FIGS. 1, 2 and 3, the housing 15 is, sleeved on the cylinder 13 and is movable axially relative to the cylinder 13. The housing 15 is comprised of first and second housing halves, 151 and 152. In the present embodiment, the housing 15 has a cylindrical portion 153 which is adjacent to the rear plate 14 and which is formed with two diametrically opposed generally U-shaped slots 154. Each of the slots 154 has a circumferentially extending first section 155, a circumferentially extending second section 156, and an axially extending third section 157 which interconnects the first and second sections, 155 and 156. It should be noted that the first sections 155 of the slots 154 extend from the corresponding third sections 157 and toward each other, and the second sections 156 of the slots 154 extend from the corresponding third sections 157 and toward each other. The housing 15 further has a generally rectangular portion 158 extending axially and rearwardly from the cylindrical portion 153. The rectangular portion 158 has two opposed horizontal walls and two opposed vertical walls which interconnect the horizontal walls. Each of the opposed horizontal walls is formed with an aligned mounting hole 159 away from the cylindrical portion 153, and an aligned positioning hole 161 between the cylindrical portion 153 and the respective mounting hole 159.

The driving unit 2 includes a movable member 21 and, a spindle seater 22. The movable member 21 is disposed movably inside the housing 15 and has a vertical end plate 210 transverse to the latch bolt 12 and a pair of spaced vertical side plates 216 extending rearwardly from the end plate 210. The end plate 210 is formed with an engaging through-hole 211 therethrough. The rear end portion 122 of the latch bolt 12 extends fittingly and rotatably through the engaging through-hole 211. The end plate 210 has an annular inner wall which defines the engaging through-hole 211 and which is formed with two opposed radially extending notches 212 that are sized to permit extension of the corresponding protrusions 128, 129 therethrough. Each of the side plates 216 is formed with an aligned longitudinally extending groove 213, and an inwardly extending push plate 214 adjacent to one end of the corresponding longitudinally extending groove 213. Each of the side plates 216 is further formed with a forwardly and outwardly extending projection 215 at the other end of the corresponding longitudinally extending groove 213.

The spindle seater 22 includes first and second halves, 221 and 222, which are identical in construction. The spindle seater 22 is disposed rotatably inside the housing 15 and is located between the side plates 216 when each of the halves 221,222 is received rotatably in a respective one of the mounting, holes 159 of the housing 15. The spindle seater 22 has a fan-shaped flange 223 which extends forwardly therefrom and which has two side walls 224 extending out of the housing 15 through the longitudinally extending grooves 213 and abutting respectively against a respective one of the forwardly and outwardly extending projections 215 of the movable member 21. Each of the halves 221,222 of the seater 22 is formed with an aligned spindle-extending through-hole 226 therethrough for the extension of a spindle (not shown) therethrough.

A connecting plate 17 is parallel to the end plate 210 of the movable member 21 and is disposed inside the housing 15 between the side plates 216 of the movable member 21. The connecting plate 17 has two opposed positioning tabs 172 which extend from the connecting plate 17 and respectively into the positioning holes 161 of the housing 15 so as to prevent movement of the connecting plate 17 relative to the housing 15. The connecting plate 17 is formed with a through-hole 171 therethrough. The through-hole 171 of the connecting plate 17 is aligned with the rear end portion 122 of the latch bolt 12.

A biasing means 23 is disposed inside the housing 15 between the end plate 210 and the connecting plate 17. In the present embodiment, the biasing means 23 is a coil spring.

Referring to FIGS. 2 and 3, in operation, when the inner wall of the end plate 210 is engaged selectively within the front engaging grooves 126, the notches 212 are thus deflected from the protrusions 128,129 of the latch bolt 12 thereby preventing axial movement of the movable member 21 relative to the latch bolt 12. At this point, rotation of the spindle will cause the seater 22 to rotate such that one of the side walls 224 of the seater 22 pushes-a respective one of the forwardly and outwardly extending projections 215 so as to move the movable member 21 relative to the housing 15 away from the front plate 11 in order to extend the front end portion 121 of the latch bolt 12 into the housing 15 and compress the coil spring 23. It should be noted that the provision of the through-hole 171 in the connecting plate 17 is used for the extension of the rear end portion 122 of the latch bolt 12 when the front end portion 121 of the same extends into the housing 15. When the spindle is released, the coil spring 23 expands to bias the front end portion 121 of the latch bolt 12 and the movable member 21 to move relative to the housing 15 toward the front plate 11 so as to extend the front end portion 121 of the latch bolt 12 out of the housing 15. It should be noted that the transversely extending flanges 124 of the latch bolt 12 abuts against the rear abutting surface 113 of the front plate 11 so as to limit the movement of the latch bolt 12 toward the front plate 11.

Figure 4:
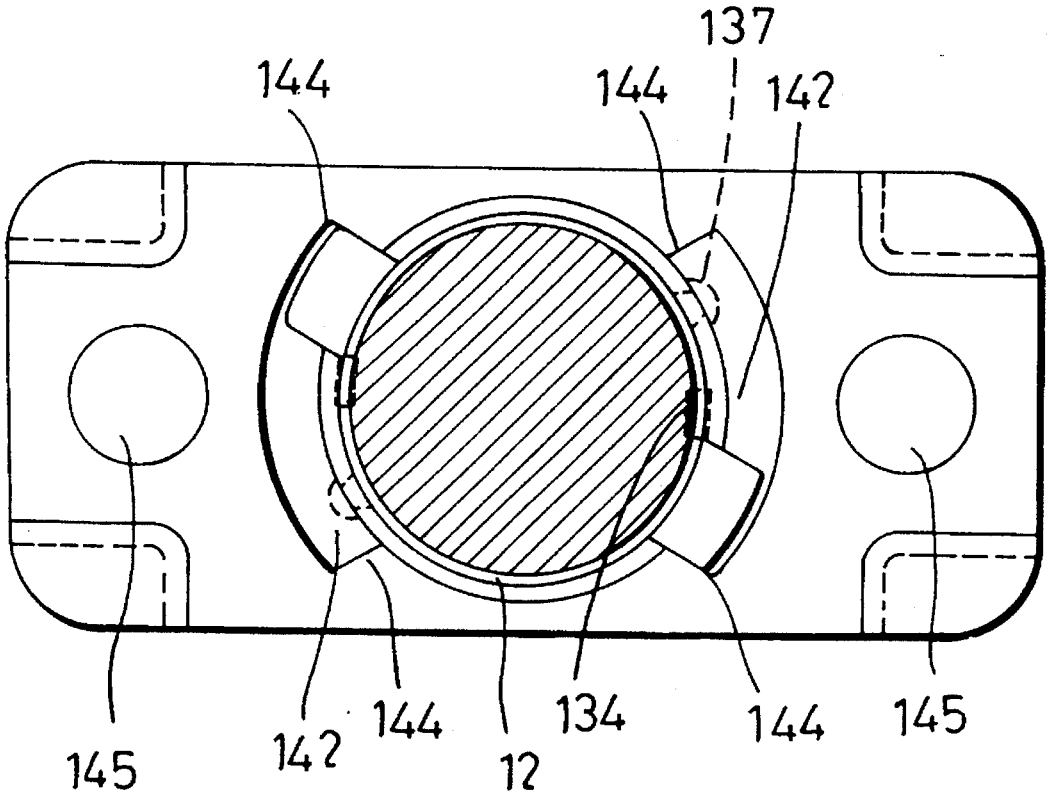
FIG. 4 is a sectional view taken along the line III—III in FIG. 3.
Figure 5:
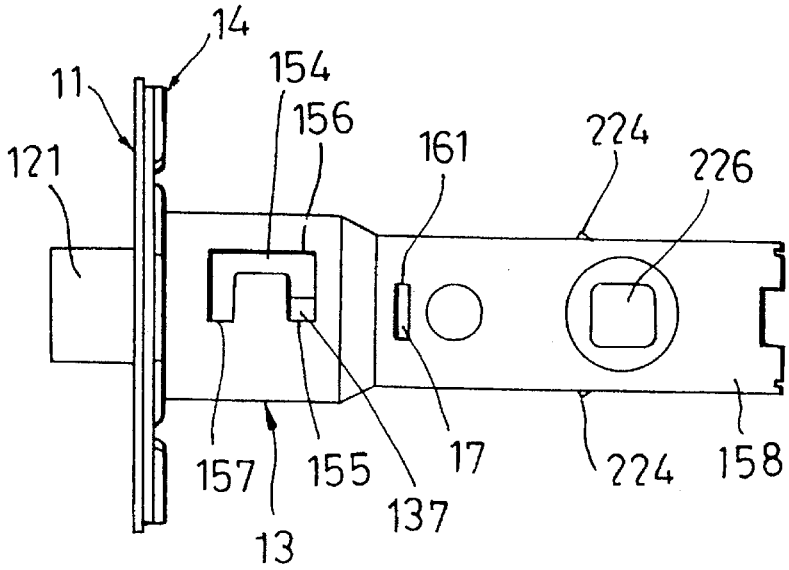
FIG. 5 is a plan view showing the door lock assembly according to the present invention when a protuberance of a cylinder is engaged within one of the first and second sections of a U-shaped slot of a housing.
Figure 6:
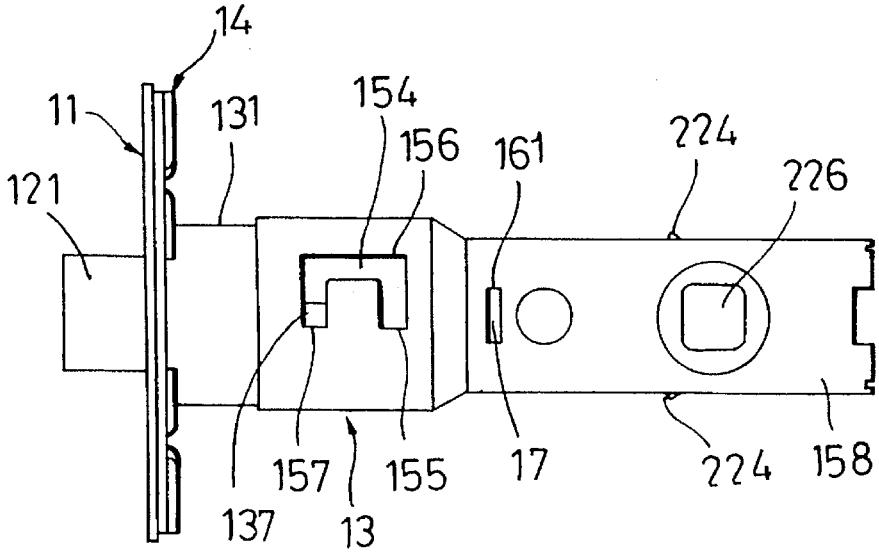
FIG. 6 is a plan view showing the door lock assembly according to the present invention when the protuberance of the cylinder is engaged within the other one of the first and second sections of the U-shaped slot of the housing.

It should be appreciated that the backset of the door lock assembly of the present invention shown in FIGS. 2 and 5 is 60 mm. The adjustment of the backset from 60 mm to 70 mm will now be described. Referring to FIGS. 4, 5 and 6, before the door lock assembly of the present invention is mounted on the edge of the door, the front plate 11 is rotated relative to the housing 15 in a first direction so as to rotate the latch bolt 12 relative to the movable member 21 to align the protrusions 128,129 of the latch bolt 12 with the notches 212 of the movable member 21 in order to disengage the inner wall of the movable member 21 from the front engaging grooves 126. Since the rear plate 14 is connected to the front plate 11, the rear plate 14 rotates synchronously with the front plate 11 so as to rotate the cylinder 1B relative to the housing 15 when the end walls 144 abut against the corresponding tabs 132 of the cylinder 1B, in turn disengaging the protuberances 137 of the cylinder 13 from the first sections 155 of the slots 154 and engaging respectively the protuberances 137 within the third section 157 of a respective one of the slots 154. At this stage, each of the transversely extending flanges 124 or the latch bolt 12 is received in a respective one of the receiving spaces 1B5 so as to prevent axial movement of the latch bolt 12 relative to the cylinder 13. Thereafter, the housing 15 is moved axially relative to the cylinder 13 away from the front plate 11 until the protuberances 137 are aligned respectively with the second section 156 of a respective one of the slots 154. Movement of the housing 15 away from the front plate 11 causes the connecting plate 17 to push the inwardly extending push plate 214 of the movable member 21 which results in the synchronous movement of the movable member 21 with the housing 15 relative to the latch bolt 12 in order to align the inner wall of the movable member 21 with the rear engaging grooves 127 of the latch bolt 12. At this time, the front plate 11 and the rear plate 14 are rotated in a second direction opposite to the first direction so as to rotate the latch bolt 12 to engage the inner wall of the movable member 21 within the rear engaging groove 127 of the latch bolt 12 and so as to rotate the cylinder 13 to engage respectively the protuberances 137 of the cylinder 13 within the second section 156 of a respective one of the slots 154. The adjustment of the backset of the door lock assembly of the present invention is thus effected. Since the adjustment of the backset from 70 mm to 60 mm is similar to the adjustment of the backset from 60 mm to 70 mm, a detailed description thereof is thus omitted herein.

While the present invention has been described in connection with what is considered the most practical, and preferred embodiment, it is understood that this invention is not limited to the disclosed embodiment, but is intended to cover various arrangements included within the spirit and scope of the broadest interpretation so as to encompass all such modifications and equivalent arrangements.

I claim:

1. A door lock assembly, comprising:

an elongated latch bolt having an enlarged front end portion and a cylindrical rear end portion which is formed with axially spaced and aligned first and second protrusions that cooperatively define a rear engaging groove therebetween, said first protrusion and said front end portion cooperatively defining a front engaging groove therebetween; and a driving unit including a movable member having a vertical end plate transverse to said latch bolt and formed therethrough with an engaging through-hole through which said rear end portion of said latch bolt extends fittingly and rotatably, said end plate having an annular inner wall which defines said engaging through-hole and which is formed with a radially extending notch that is sized to permit extension of said protrusions therethrough, said inner wall of said end plate being engaged selectively within one of said front and rear engaging grooves in a manner such that said notch is deflected from said protrusions of said latch bolt, so as to prevent axial movement of said movable member relative to said latch bolt, said latch bolt being rotatable for aligning said protrusions of said latch bolt with said notch of said movable member so as to disengage said inner wall of said movable member from said one of said front and rear engaging grooves and to permit axial movement of said movable member relative to said latch bolt in order to engage said inner wall of said movable member within the other one of said front and rear engaging grooves of said latch bolt.

2. A door lock assembly as claimed in claim 1, wherein said front end portion of said latch bolt has a transversely extending flange, said door lock assembly further comprising:

a front plate being formed therethrough with a generally rectangular first through-hole through which said front end portion of said latch bolt extends, fittingly such that said front plate can rotate synchronously with said latch bolt relative to said movable member, said front plate having a rear abutting surface;

means for biasing said front end portion of said latch bolt to extend through said first through-hole so as to abut said flange against said rear abutting surface;

a rear plate being for-med therethrough with an annular second through-hole through which said front end portion of said latch bolt extends, said rear plate being connected securely to said front plate so as to rotate synchronously with said front plate, said rear plate having a front abutting surface which abuts against said rear abutting surface of said front plate and which is formed with a circumferentially extending engaging groove communicating with said second through-hole, said engaging groove being confined by two end walls and a connecting wall interconnecting said end walls; and a hollow cylinder being sleeved on said latch bolt and having a front end portion formed with a tab which extends radially and outwardly therefrom and into said engaging groove such that said cylinder rotates synchronously with said rear plate when one of said end walls abuts against said tab of said cylinder, said cylinder further having an annular inner wall formed with a radially and inwardly extending projection adjacent to said rear abutting surface of said front plate, said projection and said rear abutting surface of said front plate cooperatively defining a receiving space therebetween, said flange of said latch bolt being received in said receiving space when said latch bolt is rotated to align said protrusions of said latch bolt with said notch of said movable member.

3. A door lock assembly as claimed in claim 2, wherein said cylinder further has a rear end portion which is formed with a radially and outwardly extending protuberance, said door lock assembly further comprising:

a hollow housing which is sleeved on said cylinder and said movable member and which is movable axially relative to said cylinder, said housing having a cylindrical portion which is adjacent to said rear plate and which is formed with a generally U-shaped slot, said slot having a circumferentially extending first section, a circumferentially extending second section aligned with said first section, and an axially extending third section interconnecting said first and second sections; and a connecting plate connecting said housing to said movable member such that said housing moves synchronously with said movable member when said latch bolt is rotated to align said protrusions of said latch, bolt with said notch of said movable member, said protuberance of said cylinder being engaged within one of said first and third slots when said latch bolt is rotated to align said protrusions of said latch bolt with said notch of said movable member so as to prevent axial movement of said housing relative to said cylinder, said cylinder being rotatable to disengage said protuberance from said one of said first and second sections and to permit axial movement of said housing relative to said cylinder in order to engage said protuberance of said cylinder within the other one of said first and second sections of said slot.

* * * * *